US005579877A

United States Patent [19]

Homayoon

[11] Patent Number: 5,579,877

[45] Date of Patent: Dec. 3, 1996

[54] SUITCASES WITH TANK TRACK ROLLER ASSEMBLIES AND PULL HANDLES

[76] Inventor: Richard Homayoon, P.O. Box 99673, San Diego, Calif. 92169-1673

[21] Appl. No.: 223,010

[22] Filed: Apr. 5, 1994

[51] Int. Cl.[6] ..... A45C 5/14; A45C 13/26

[52] U.S. Cl. ..... 190/18 A; 190/39; 190/115; 280/37; 280/5.22; 16/112

[58] Field of Search ..... 190/18 A, 39, 190/115, 15.1; 280/37, 655, 655.1, 47.29, 47.315, 8.22; 16/112, 115

[56] References Cited

U.S. PATENT DOCUMENTS

| | | | |
|---|---|---|---|
| 970,787 | 9/1910 | Brown | 280/5.22 |
| 2,392,926 | 1/1946 | Kelly | 190/18 A X |
| 2,463,391 | 3/1949 | Kanaley | 190/18 A |
| 3,522,955 | 8/1970 | Warner, Jr. | 190/18 A X |
| 3,810,649 | 5/1974 | Fahey, Jr. | 280/37 |
| 4,215,769 | 8/1980 | Kuc | 190/18 A |
| 4,995,129 | 2/1991 | Comardo | 280/37 X |
| 5,005,255 | 4/1991 | Parf et al. | 16/115 |
| 5,075,925 | 12/1991 | Maloney | 190/115 X |
| 5,197,579 | 3/1993 | Bieber et al. | 190/115 X |
| 5,330,037 | 7/1994 | Wang | 190/18 A |

FOREIGN PATENT DOCUMENTS

| | | | |
|---|---|---|---|
| 1438733 | 4/1966 | France | 280/37 |
| 2652327 | 3/1991 | France | 280/5.22 |
| 8403821 | 10/1984 | WIPO | 190/18 A |

*Primary Examiner*—Sue A. Weaver

[57] ABSTRACT

A suitcase with a tank track roller assembly comprises a first segment and a second segment. At least one of the segments is formed as a hollow generally rectangular shaped box with one open side. One segment includes a carry handle affixed to its upper extent and one segment includes a long indentation. A track roller assembly is comprised of a flexible track and a plurality of wheels. The wheels are formed in a cylindrical configuration with holes at their center. A base is formed as the lower extent of the suitcase which includes a plurality of downwardly extending members with a centrally located aperture extending therethrough. A plurality of axles is centrally positioned within the apertures in the members. Each axle has a wheel mounted on each end thereof. The track is positioned around the wheels forming an oval shaped configuration. A hinge has two generally planar rectangular wings. The wings join the first and second segments. A pull handle consists of a long cylindrically shaped rod. The rod is positioned within the indentation in one segment. The handle includes a locking mechanism adapted to allow fastening of the handle at different angles with respect to the plane of the top section.

1 Claim, 3 Drawing Sheets

FIG. 1
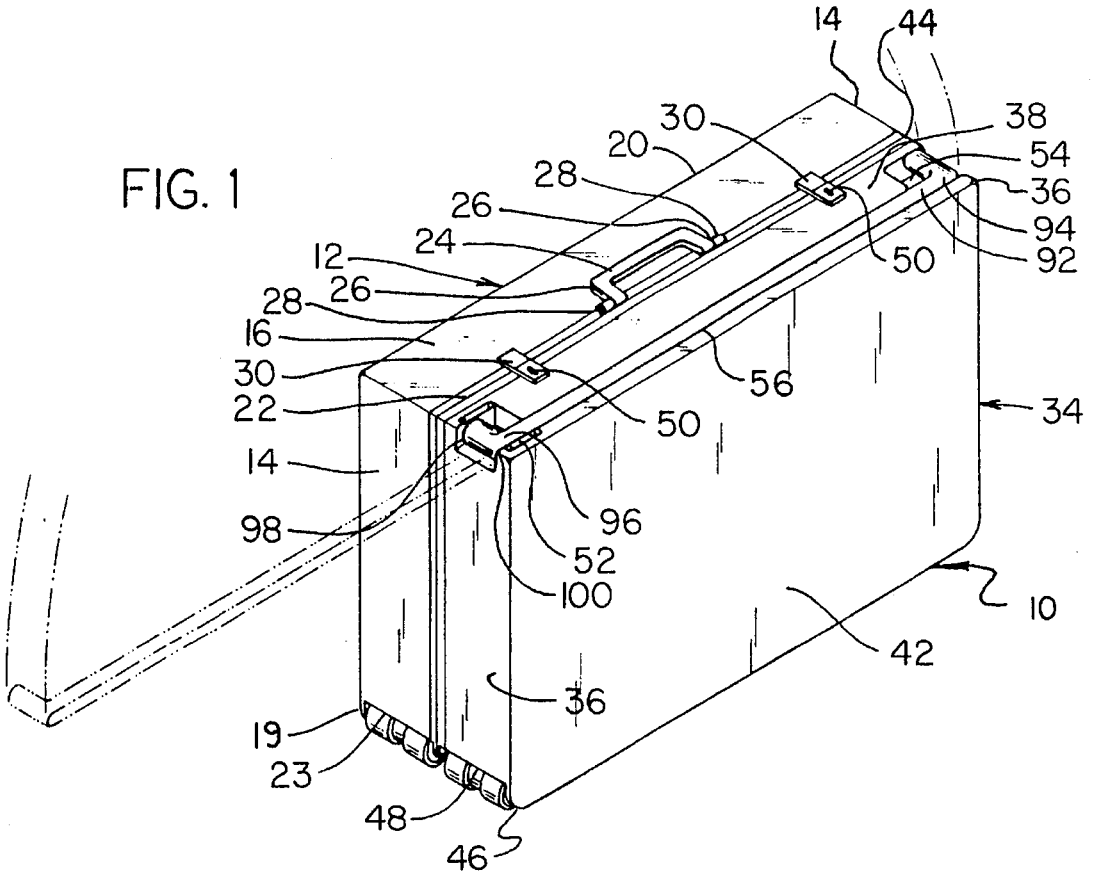
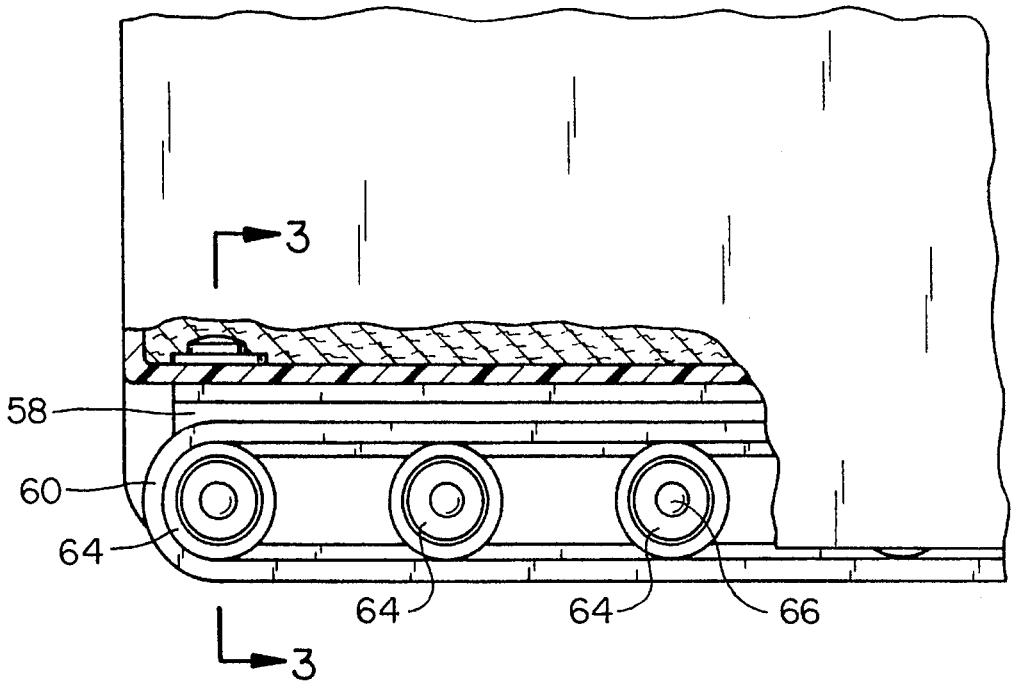
FIG. 2

SUITCASES WITH TANK TRACK ROLLER ASSEMBLIES AND PULL HANDLES

BACKGROUND OF THE INVENTION

1. Field of the Invention

The present invention relates to suitcases with tank track roller assemblies and more particularly pertains to aiding users in transporting suitcases up staircases and other rough terrain by rolling the tank tracks directly over the obstacles.

2. Description of the Prior Art

The use of wheeled suitcases is known in the prior art. More specifically, wheeled suitcases heretofore devised and utilized for the purpose of aiding users in transporting suitcases are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No 4,679,670 to Wickman a wheeled suitcase and handle.

U.S. Pat. No. 4,228,877 to Cothary discloses a wheeled suitcase with extendable handle means.

U.S. Pat. No. 4,463,840 to Seynhaeve discloses a wheeled suitcase.

U.S. Pat. No. 4,995,487 to Plath discloses a wheeled suitcase and luggage support.

Lastly, U. S. Pat. No. Des. 280,680 to Bomes discloses a wheeled suitcase.

In this respect, the suitcases with tank track roller assemblies according to the present invention substantially depart from the conventional concepts and designs of the prior art, and in doing so provide an apparatus primarily developed for the purpose of aiding users in transporting suitcases up staircases and other rough terrain by rolling the tank tracks directly over the obstacles.

Therefore, it can be appreciated that there exists a continuing need for new and improved suitcases with tank track roller assemblies which can be used for aiding users in transporting suitcases up staircases and other rough terrain by rolling the tank tracks directly over the obstacles. In this regard, the present invention substantially fulfills this need.

SUMMARY OF THE INVENTION

In view of the foregoing disadvantages inherent in the known types of wheeled suitcases now present in the prior art, the present invention provides improved suitcases with tank track roller assemblies. As such, the general purpose of the present invention, which will be described subsequently in greater detail, is to provide new and improved suitcases with tank track roller assemblies and method which has all the advantages of the prior art and none of the disadvantages.

To attain this, the present invention essentially comprises a new and improved suitcase with a tank track roller assembly comprising a rear segment formed as a hollow generally rectangular shaped box with parallel vertical sidewalls, a top section, a bottom section and a large back wall. The top section, bottom section and sidewalls having a small width. The front portion of the rear segment has an open end positioned opposite from the large back wall. The edges of the back wall of the rear segment extend vertically below the horizontal portion of the bottom section. The rear segment also includes an inverted U shaped carry handle with coupling means on its free ends. The open edge of the rear segment includes coupling means for attachment of the handle. A generally rectangular shaped buckle is centrally positioned between the carry handle and each sidewall. Each buckle includes a portion which extends over the open edge in the operative orientation.

A front segment is formed as a hollow generally rectangular shaped box with parallel vertical sidewalls, a top section, a bottom section and a large front wall. The top section, bottom section and sidewalls have a small width. The back portion of the front segment has an open end which is positioned opposite the large front wall. The edges of the front wall of the front segment extend vertically below the horizontal portion of the bottom section. The open edge of the top wall includes upwardly extending pieces adapted to be coupled with the buckles on the rear segment. The corners located at the intersection of the top wall and sidewalls have large generally rectangular shaped indentations. A long thin, generally rectangular indentation connects the two therebetween.

A track roller assembly is comprised of a flexible track, a base and a plurality of wheels and axles. The wheels are formed in a generally cylindrical configuration with two flat ends which have a circular hole at their center. The circumference of the wheels include a centrally located groove. The base is formed in a generally planar, rectangular configuration. A plurality of centrally located, downwardly extending U-shaped brackets is positioned equidistantly throughout its extent. Each bracket includes a centrally located circular hole extending therethrough. The base includes a screw hole located to the side of each bracket. The brackets are cooperatively coupled to the bottom section of the rear and front segments by a short bolt with external screw threads. The wheels are coupled to each side of the downwardly extending bracket by an axle threaded through the aligned holes in the wheels and bracket. The axles include coupling means at each end to securely retain the wheels thereupon. The track is comprised of a flexible material and formed in a generally planar oval configuration. The track has a small thickness and a width equal to that of the wheels. The track includes a centrally located raised rib extending the full extent of the track. The rib is adapted to fit securely within the groove in the wheels when in the operative orientation.

A plurality of hinges has two generally planar rectangular wings joined by a cylindrical pivot. The pivot is positioned at the lowermost extent of the hinge. The wings of the hinges include coupling means and are affixed to one side of each segment. The wings are positioned on the portion of the long side edges which extend below the horizontal portion of the bottom section of each respective segment. The hinge is adapted to permit opening of the case to a ninety degree position.

A pull handle consists of a long cylindrically shaped pull handle with an upper end and a lower end. The upper end and lower end are both formed in an L-shaped configuration and are contoured to fit securely within the indentations in the upper surface of the front segment. The lower end includes a centrally located aperture. A pin is coupled to each end of the indentation and is threaded through the aperture to permit circular rotation of the lower end of the handle.

A handle assembly is located within the hollow interior of the front segment. A compression spring component of the assembly is located adjacent to the lower end of the handle. The compression spring includes a cylindrically shaped pin at its upper extent. A locking plate is vertically positioned adjacent to the spring. The plate consists of a planar rectangular member with at least one circular hole located in a semicircular alignment. The plate also has the lower end of the handle affixed thereto about a pivot point. The pin portion of the compression spring is adapted to couple through the hole in the handle and a hole in the rectangular plate when they are positioned in alignment due to rotation of the handle. Such coupling locks the handle in place to permit towing of the apparatus. The apparatus includes a cable with one of its ends connected to the lower extent of the spring. A pulley wheel is positioned near the corner of the front segment with the cable threaded thereupon. An L-shaped member is located at the opposite corner of the front section. The member has apertures at both ends and at the intersection of its short and long ends. The member is mounted to the sidewall at the aperture in the intersection. The short end is coupled to the cable which extends across the front wall of the front segment. The long end of the member is connected to a long cylindrical rod with a push button at its upper extent. The push button is adapted so that when depressed, the cable extends causing the compression spring below the lower end of the handle to uncouple from its locked position within the holes, thereby permitting the user to adjust the angle of the handle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide new and improved suitcases with tank track roller assemblies which have all the advantages of the prior art wheeled suitcases and none of the disadvantages.

It is another object of the present invention to provide new and improved suitcases with tank track roller assemblies which may be easily and efficiently manufactured and marketed.

It is further object of the present invention to provide new and improved suitcases with tank track roller assemblies which are of durable and reliable constructions.

An even further object of the present invention is to provide new and improved suitcases with tank track roller assemblies which are susceptible of a low cost of manufacture with regard to both materials and labor, and which accordingly are then susceptible of low prices of sale to the consuming public, thereby making such suitcases with tank track roller assemblies economically available to the buying public.

Still yet another object of the present invention is to provide new and improved suitcases with tank track roller assemblies which provide in the apparatuses and methods of the prior art some of the advantages thereof, while simultaneously overcoming some of the disadvantages normally associated therewith.

Still another object of the present invention is to aid users in transporting suitcases up staircases and other rough terrain by rolling the tank tracks directly over the obstacles.

Lastly, it is an object of the present invention to provide new and improved suitcases with tank track roller assemblies comprising a first segment and a second segment. At least one of the segments is formed as a hollow generally rectangular shaped box with one open side. One segment includes a carry handle affixed to its upper extent and one segment includes a long indentation. A track roller assembly is comprised of a flexible track and a plurality of wheels. The wheels are formed in a cylindrical configuration with holes at their center. A base is affixed to the lower extent of the apparatus which includes a plurality of downwardly extending members with a centrally located aperture extending therethrough. A plurality of axles is centrally positioned within the apertures in the members. Each axle has a wheel mounted on each end thereof. The track is positioned around the wheels forming an oval shaped configuration. A hinge has two generally planar rectangular wings. The wings join the first and second segments. A pull handle consists of a long cylindrically shaped rod. The rod is positioned within the indentation in one segment. The handle includes a locking mechanism adapted to allow fastening of the handle at different angles with respect to the plane of the top section.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the suitcases with tank track roller assemblies constructed in accordance with the principles of the present invention.

FIG. 2 is a broken away perspective view of the track roller assembly of the suitcases with tank track roller assemblies.

The same reference numerals refer to the same parts through the various Figures.

DESCRIPTION OF THE PREFERRED EMBODIMENT

Figure 3:
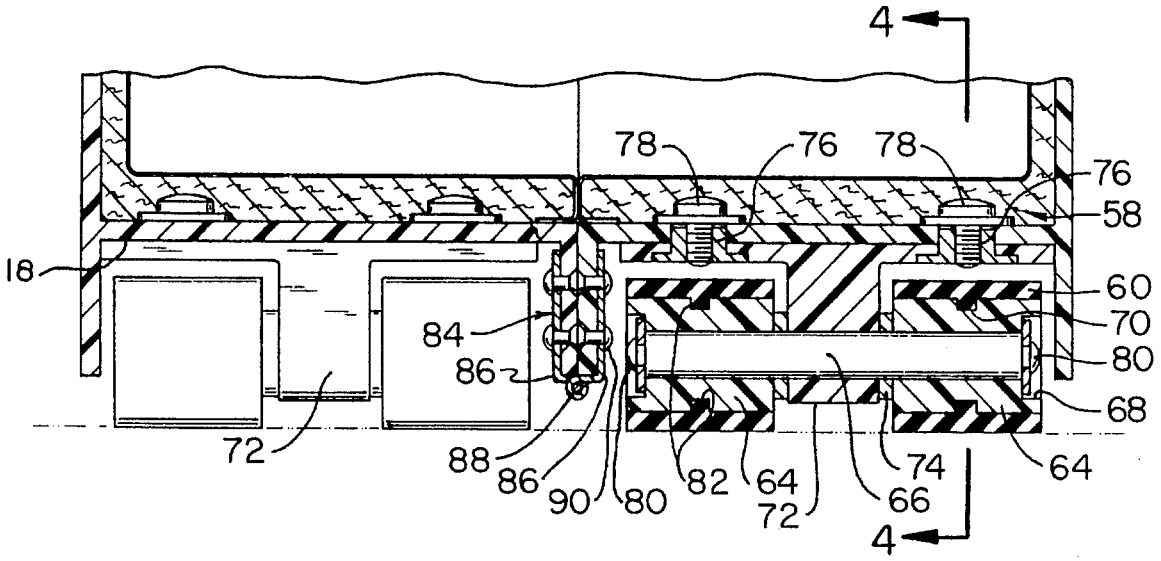
FIG. 3 is a cross sectional view of the track roller assembly taken along line 3—3 of FIG. 2.

With reference now to the drawings, and in particular to FIG. 1 thereof, the preferred embodiment of the new and improved suitcases with tank track roller assemblies embodying the principles and concepts of the present invention and generally designated by the reference numeral 10 will be described.

Figure 4:
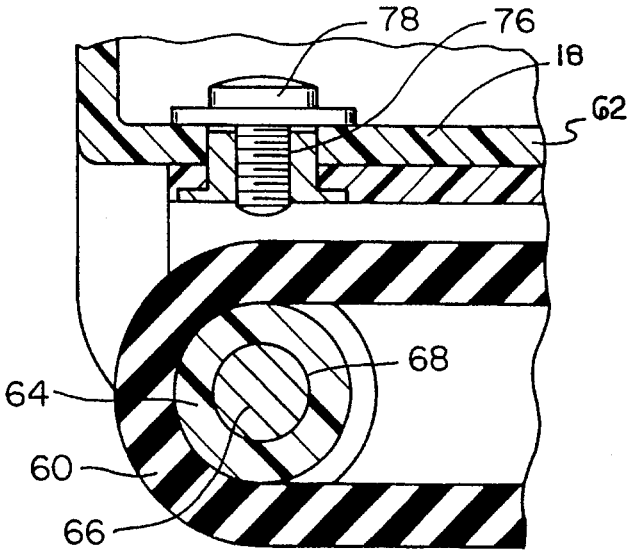
FIG. 4 is a broken away exploded perspective view of the track roller assembly taken along line 4—4 of FIG. 3.
Figure 5:
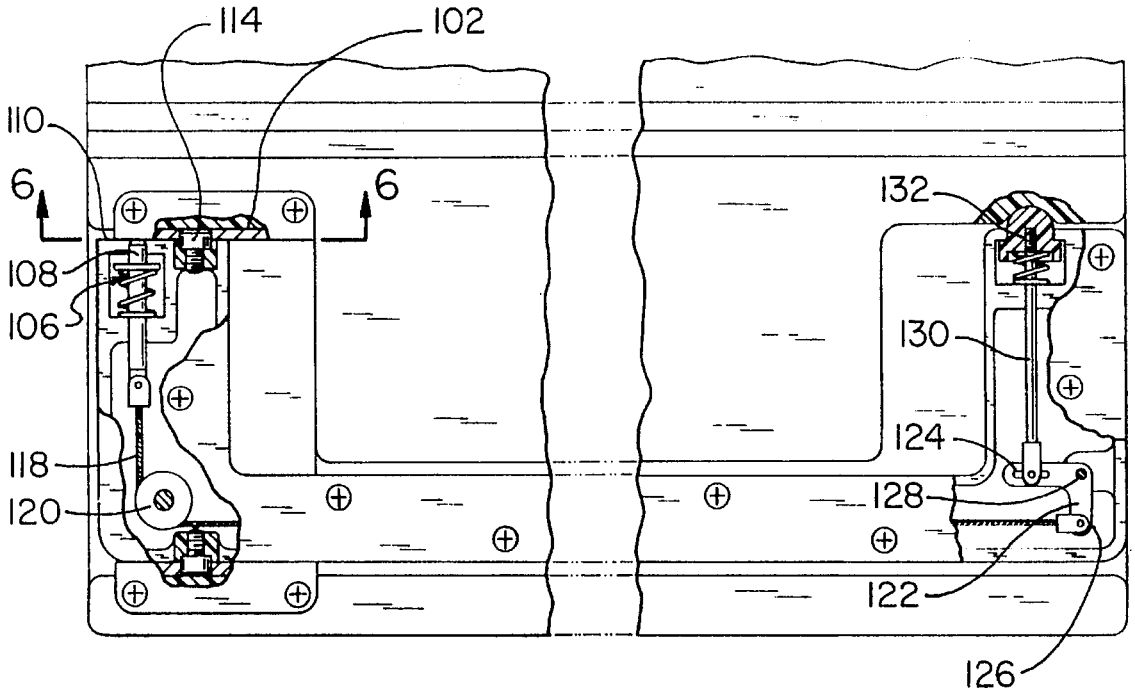
FIG. 5 is a broken away perspective view of the pull handle assembly of the suitcases with tank track roller assemblies.
Figure 6:
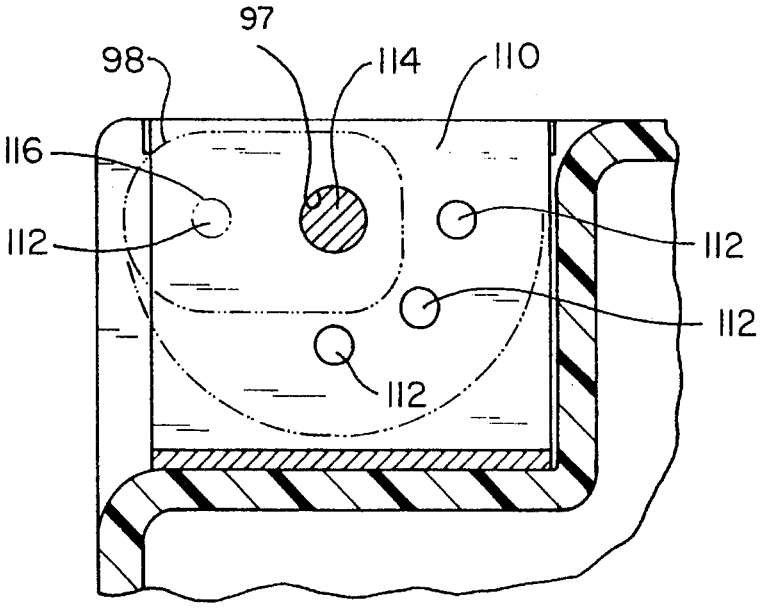
FIG. 6 is an exploded cross sectional view of the pull handle assembly taken along line 6—6 of FIG. 5.

Specifically, it will be noted in FIGS. 1 through 6, that there is provided a new and improved suitcases with tank track roller assemblies. The suitcase, in its broadest context, comprises a rear segment 12, a front segment 34, a track roller assembly 58, a plurality of hinges 84, a pull handle 92 and a handle assembly 102.

More specifically, the rear segment 12 is formed as a hollow generally rectangular shaped box with parallel vertical sidewalls 14, a top section 16, a bottom section 18 and a large back wall 20. The top section 16, bottom section 18 and sidewalls 14 have a small width with respect to the back wall. The front portion of the rear segment 12 has an open end 22 positioned opposite from the large back wall 20. The large hollow interior of the rear segment permits a user to pack a large quantity of clothing. The edges 19 of the back wall of the rear segment 12 extend vertically below the horizontal portion 23 of the bottom section. This configuration creates a recessed area under the horizontal portion of the bottom section. Note FIG. 1.

The rear segment 12 also includes an inverted U-shaped carry handle 24 with coupling means on its free ends 26. The handle is comprised of sturdy materials to permit carrying of a large amount of weight. The open edge of the rear segment includes coupling means 28 for attachment of the handle 24. A generally rectangular shaped buckle 30 is centrally positioned between the carry handle 24 and each sidewall 14. Each buckle 30 includes a portion which extends over the open end 22 in the operative orientation. Note FIG. 1 in particular.

A front segment 34 is formed as a hollow generally rectangular shaped box with parallel vertical sidewalls 36, a top section 38, a bottom section 40 and a large front wall 42. The top section 38, bottom section 40 and sidewalls 36 have a small width with respect to the front wall. The back portion of the front segment has an open end 44 which is positioned opposite the large front wall 42. The large hollow interior of the rear segment, coupled with that of the front segment, permits a user to pack a large quantity of clothing in the suitcase. Note FIG. 1.

The edges 46 of the front wall of the front segment 34 extend vertically below the horizontal portion 48 of the bottom section 40. This configuration creates a recessed area under the horizontal portion of the bottom section. The open edge 44 of the top section 38 includes upwardly extending pieces 50 adapted to be coupled with the buckles 30 on the rear segment. The buckles in the rear segment are configured to extend onto the top of the front section to permit coupling. The corners located at the intersection of the top section 38 and sidewalls 36 have large generally rectangular shaped indentations 52, 54. A long thin, generally rectangular indentation 56 connects the two therebetween. Note FIG. 1.

A track roller assembly 58 is comprised of a flexible track 60, a base 62 and a plurality of wheels 64 and axles 66. The wheels 64 are formed in a generally cylindrical configuration with two flat ends which have a circular hole 68 at their center. The circumference of the wheels include a centrally located groove 70. The base 62 is formed in a generally planar, rectangular configuration. A plurality of centrally located, downwardly extending brackets 72 is positioned equidistantly throughout its extent. Each bracket 72 includes a centrally located circular hole 74 extending therethrough. The base includes a screw hole 76 located to the side of each bracket 72. The brackets are cooperatively coupled to the bottom section of the rear and front segments by a short bolt 78 with external screw threads. The base is affixed to the lower surface of the bottom sections of both segments of the suitcase with in the recessed area. Note FIGS. 1 and 3.

The wheels 64 are coupled to each side of the downwardly extending bracket 72 by an axle 66 threaded through the aligned holes in the wheels and bracket. Each segment, therefore, includes a plurality of pairs of roller wheels mounted to its bottom section. The axles 66 include coupling means 80 at each end to securely retain the wheels thereupon. The coupling means also permit the wheels to roll quite easily when force is applied to the tracks. Note FIGS. 2, 3 and 4.

The track 60 is comprised of a flexible material and formed in a generally planar oval configuration. The track 60 has a small thickness and a width equal to that of the wheels. The track includes a centrally located raised rib 82 extending the full extent of the track. The rib 82 is adapted to fit securely within the groove 70 in the wheels when in the operative orientation. The track fits over the wheels of both segments. When a user pulls the suitcase, force is applied to the track and it rolls. The grooves in the wheels firmly secure the ribs in the track keeping the track taught. The taught orientation of the track allows a user to easily roll the suitcase up staircases or over rough terrain. The track also adds stability the suitcase when traveling over normal smooth surfaces. Note FIGS. 2, 3 and 4.

A plurality of hinges 84 has two generally planar rectangular wings 86 joined by a cylindrical pivot 88. The pivot 88 is positioned at the lowermost extent of the hinge. In this ideal location the hinges do not interfere with the operation of the tracks. The wings 86 of the hinges include coupling means 90 and are affixed to one side of each segment. The wings 86 are positioned on the portion of the edges of the front and back walls 18, 20 which extend below the horizontal portion 23, 48 of the bottom section of each respective segment. The hinge 84 is adapted to permit opening of the case to a ninety degree position. The hinges are comprised of sturdy materials to enhance durability. Note FIG. 3.

A pull handle 92 consists of a long cylindrically shaped pull handle with an upper end 94 and a lower end 96. The upper end 94 and lower end 96 are both formed in an L-shaped configuration and are contoured to fit securely within the indentations 52, 54, 56 in the upper surface of the front segment. The upper end of the handle has a gripping surface which facilitates pulling of the suitcase by both right and left handed individuals. Note FIG. 1.

The lower end 96 includes a centrally located aperture 97. A pin 100 is coupled to each end of the indentation and is threaded through the aperture 97 to permit circular rotation of the lower end 98 of the handle. The lower end 98 of the handle also includes a circular hole 116. When not in use, the handle is conveniently stored in the contoured indentation in the upper surface of the front section. Note FIG. 1.

A handle assembly 102 is located within the hollow interior of the front segment 34. A compression spring component 106 of the assembly is located adjacent to the lower end 98 of the handle 92. The compression spring 106 includes a cylindrically shaped pin 108 at its upper extent. A locking plate 110 is vertically positioned adjacent to the spring 106. The plate 110 consists of a planar rectangular member with at least one circular hole 112 located in a semicircular alignment. The plate 110 also has the lower end 98 of the handle affixed thereto about a pivot point 114. The pin portion 108 of the compression spring 106 is adapted to couple through the hole 116 in the handle and a hole in the rectangular plate 112 when they are positioned in alignment due to rotation of the handle. Such coupling locks the handle in place to permit towing of the apparatus.

The apparatus 102 includes a cable 118 with one of its ends connected to the lower extent of the spring biased pin 108. A pulley wheel 120 is positioned near the corner of the front segment with the cable 118 threaded thereupon. An L-shaped member 122 is located at the opposite corner of the front section. The long end of the member is positioned in a horizontal orientation, with the short end positioned vertically with respect to the long end. The member 122 has apertures 124, 126 at both ends and at the intersection 128 of its short and long ends. The member 122 is mounted to the sidewall 36 at the aperture 128 in the intersection. Note FIGS. 5 and 6.

The member is mounted so that it can pivot when force is applied to either of its ends. The short end is coupled to the cable 118, which extends across the front wall of the front segment. The long end of the member 122 is connected to a long cylindrical rod 130 with a push button 132 at its upper extent. The push button 132 is adapted so that when depressed, the rod 130 is forced toward the front wall causing the long end of the L-shaped member 122 to pivot. This causes the cable 118, which is attached to the L-shaped member, to extend causing the compression spring 106 below the lower end 98 of the handle to uncouple from its locked position within the holes. This permits the user to adjust the angle of the pull handle to any of several different locking positions. The push button is conveniently located in the indentation adapted for receipt of the upper end of the pull handle. Note FIGS. 5 and 6.

The suitcase with a tank track roller assembly was developed to aid users in transporting their luggage up staircases and over other rough terrain. This is accomplished by use of a tank track roller assembly consisting a plurality of axle mounted wheels and a track adapted to fit around the wheels. The assembly is partially recessed within the lower portion of the suitcase to enhance its durability. The tank track permits a user to pull the suitcase up staircases, over curbs, pot holes, gravel and other rough terrain. Over level ground, the tank tracks provide a much smoother transport means than conventional wheels.

Another feature of the suitcase is the adjustable pull handle. The handle has a gripping surface which facilitates pulling of the suitcase by both right and left handed individuals. The handle is adapted to permit locking of the handle at several different angles to conform to the height of the user. The locking angle easily changed by the user by depressing a push button on the upper surface of the suitcase.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved suitcase with a tank track roller assembly comprising, in combination:

a rear segment formed as a hollow generally rectangular shaped box with parallel vertical sidewalls, a top section, a bottom section with a horizontal portion and a large back wall, the top section, bottom section with a horizontal portion and sidewalls having a small width, the rear segment having a front portion with an open end positioned opposite the large back wall, with the back wall of the rear segment having edges extending vertically below the horizontal portion of the bottom section, the rear segment also including a carry handle with coupling means on its free ends, the rear segment having an open edge including coupling means for attachment of the handle, a generally rectangular shaped buckle being centrally positioned between the carry handle and each side wall, each buckle having a portion which extends over the edge in the operative orientation;

a front segment formed as a generally rectangular shaped box with a hollow interior and with parallel vertical sidewalls, a top section with an upper surface, a bottom section with a horizontal portion and a large front wall, with the top section, bottom section and sidewalls having a small width, the front segment having a back portion with an open end positioned opposite the large front wall, the large front wall having edges extending vertically below the horizontal portion of the bottom section, the top section including an open edge with upwardly extending pieces adapted to be coupled with the buckles on the rear segment, corners formed at the intersection of the top section and sidewalls having large generally rectangular shaped indentions with a long thin generally rectangular indentation with long side edges connecting the two therebetween;

a track roller assembly comprised of a flexible track, a base and a plurality of wheels and axles, the wheels being formed in a generally cylindrical configuration with two flat ends having a circular hole at their center, the circumference of the wheels including a centrally located groove, the base being formed in a generally planar rectangular configuration with a plurality of centrally located downwardly extending brackets positioned equidistantly throughout its extent, each bracket including an upper screw hole and a centrally located circular hole extending therethrough, the base including a screw hole located to the side of each bracket, the brackets being cooperatively coupled to the bottom section of the rear and front segments by a short threaded bolt positioned through the aligned screw holes of the base and bracket, the wheels being coupled to each side of the downwardly extending bracket by an axle threaded through the aligned holes in the wheels and bracket, the axles including coupling means at each end to securely retain the wheels thereupon, the track being comprised of a flexible material and formed in a generally planar oval configuration with a small thickness and a width equal to that of the wheels, the track including a centrally located raised rib extending the full extent of the track, the rib adapted to fit securely within the groove in the wheels when in the operative orientation;

a plurality of hinges having two generally planar rectangular wings joined by a cylindrical pivot, the pivot being positioned at the lowermost extent of the hinge, the wings of the hinges including coupling means and affixed to one side of each segment, the wings being positioned on the portion of the long side edges which extend below the horizontal portion of the bottom section of each respective segment, the hinge adapted to permit opening of the case to a ninety degree position;

a pull handle consisting of a long cylindrically shaped pull handle with an upper end and a lower end, the upper end and lower end both being formed in an L-shaped configuration and contoured to fit securely within the indentations in the upper surface of the front segment, the lower end including a centrally located aperture, a pin coupled to each end of the indentation being threaded through the aperture to permit circular rotation of the lower end of the handle, the lower end of the handle also including a hole extending therethrough; and a handle assembly being located within the hollow interior of the front segment, a compression spring in the assembly being located adjacent to the lower end of the handle, the compression spring including a cylindrically shaped pin at its upper extent, a locking plate being vertically positioned adjacent to the compression spring, the plate consisting of a planar rectangular member with at least one circular hole, the plate also including the lower end of the handle affixed thereto about a pivot point, the pin portion of the compression spring being adapted to couple through the hole in the handle and a hole in the rectangular plate when positioned in alignment due to rotation of the handle, such coupling locking the handle in place to permit towing of the apparatus, the handle assembly including a cable with one of its ends being connected to the lower extent of the compression spring, a pulley wheel being positioned near one of the corners of the front segment with the cable being threaded thereupon, an L-shaped member being located at the opposite corner of the front segment, the member having apertures at both ends and at the intersection of its short and long ends, the member being mounted to one of the sidewalls at the aperture in the intersection, with the short end being coupled to the cable which extends across the large front wall of the front segment, the long end of the member being connected to a long cylindrical rod with a push button at its upper extent, the push button adapted so that when depressed the cable extends causing the compression spring below the lower end of the handle to uncouple from its locked position within the holes, thereby permitting the user to adjust the angle of the handle.

* * * * *